US007067470B2

(12) United States Patent
Cauwberghs et al.

(10) Patent No.: US 7,067,470 B2
(45) Date of Patent: Jun. 27, 2006

(54) FABRIC CARE COMPOSITIONS HAVING REDUCED FABRIC ABRASION

(75) Inventors: Serge Gabriel Pierre Roger Cauwberghs, Nieuwkerken (BE); Raphael Angeline Alfons Ceulemans, Lubbeek (BE); Neil James Gordon, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 67 days.

(21) Appl. No.: 10/951,753

(22) Filed: Sep. 28, 2004

(65) Prior Publication Data

US 2005/0065057 A1 Mar. 24, 2005

Related U.S. Application Data

(63) Continuation of application No. 10/816,976, filed on Apr. 2, 2004, now abandoned, which is a continuation of application No. 09/830,793, filed as application No. PCT/US99/24941 on Oct. 22, 1999, now Pat. No. 6,794,355.

(60) Provisional application No. 60/106,759, filed on Nov. 2, 1998, provisional application No. 60/110,310, filed on Nov. 30, 1998.

(51) Int. Cl.
*C11D 3/37* (2006.01)
*C11D 3/30* (2006.01)

(52) U.S. Cl. ..... 510/475; 510/499

(58) Field of Classification Search ..... 510/475, 510/499
See application file for complete search history.

(56) References Cited

U.S. PATENT DOCUMENTS

| | | | | |
|---|---|---|---|---|
| 4,076,497 | A * | 2/1978 | Freyberg et al. | 8/532 |
| 4,126,563 | A | 11/1978 | Barker | |
| 4,248,928 | A | 2/1981 | Spadini et al. | |
| 4,634,544 | A | 1/1987 | Weber et al. | |
| 4,711,740 | A | 12/1987 | Carter et al. | |
| 4,997,680 | A * | 3/1991 | Tschang et al. | 427/306 |
| 5,437,928 | A * | 8/1995 | Thimons et al. | 428/391 |
| 5,460,752 | A | 10/1995 | Fredj et al. | |
| 5,534,182 | A | 7/1996 | Kirk et al. | |
| 5,585,034 | A | 12/1996 | Lysy et al. | |
| 5,643,989 | A * | 7/1997 | Van De Grampel et al. | 524/494 |
| 5,767,062 | A | 6/1998 | Trinh et al. | |
| 5,776,883 | A | 7/1998 | Vasudevan | |
| 5,804,219 | A | 9/1998 | Trinh et al. | |
| 5,932,253 | A | 8/1999 | Trinh et al. | |

FOREIGN PATENT DOCUMENTS

| | | |
|---|---|---|
| DE | 2232353 | 1/1973 |
| EP | 664332 A1 | 7/1995 |
| EP | 719856 A1 | 7/1996 |
| WO | WO 95/03390 | 2/1995 |
| WO | WO 95/06098 | 3/1995 |

* cited by examiner

*Primary Examiner*—John R. Hardee
(74) *Attorney, Agent, or Firm*—David V. Upite

(57) ABSTRACT

The present in relates to fabric enhancement compositions which provide reduced fabric abrasion damage.

5 Claims, 1 Drawing Sheet

FABRIC CARE COMPOSITIONS HAVING REDUCED FABRIC ABRASION

CROSS REFERENCE TO RELATED APPLICATION

Figure 1:
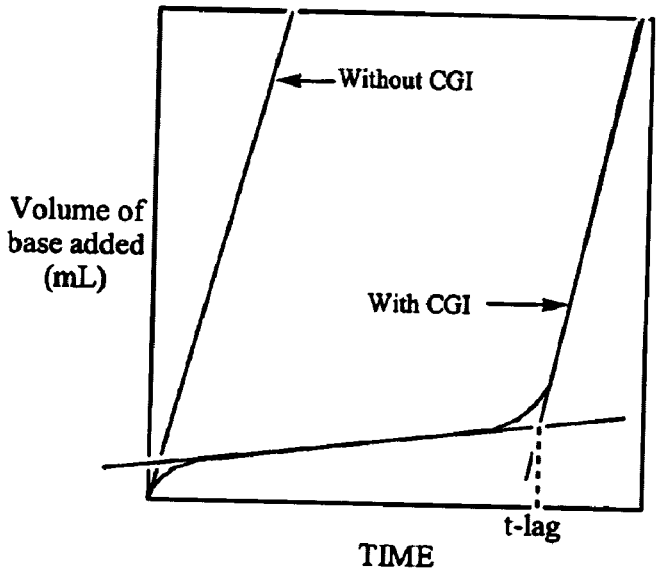

This application is a continuation of U.S. application Ser. No. 10/816,976, filed Apr. 2, 2004 now abandoned, which is a continuation of U.S. application Ser. No. 09/830,793, now U.S. Pat. No. 6,794,355, granted Sep. 21, 2004, which is a 371 of PCT/US99/24941 filed Oct. 22, 1999, which claims the benefit of U.S. Provisional Application No. 60/106,759, filed Nov. 2, 1998 and of U.S. Provisional Application No. 60/110,310, filed Nov. 30, 1998 (now abandoned), the disclosure of which is incorporated by reference.

FIELD OF THE INVENTION

The present invention relates to fabric care compositions which provide fabric enhancement benefits while reducing the damage to fabric from abrasion. The Compositions of the present invention comprise one or more fabric abrasion reducing polymers as well as other ingredients which provide a benefit to the consumer inter alia fabric softening, anti-static, dye fixation.

BACKGROUND OF THE INVENTION

The domestic treatment of fabric is a problem known in the art to the formulator of laundry compositions. Hence, It is well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways. Short fibers are dislodged from woven and knit fabric/textile structures by the mechanical action of laundering. These dislodged fibers may form lint, fuzz or "pills" which are visible on the surface of fabrics and diminish the appearance of newness of the fabric. Such a problem of fabric abrasion is even more acute after multi-wash cycles.

There exists a long felt need for compositions which provide fabric with protection against damage done due to fabric abrasion. In addition, there is a long felt need to provide compositions which provide a remedy for fabric abrasion damage.

SUMMARY OF THE INVENTION

The present invention meets the aforementioned needs in that it has been surprisingly discovered that certain higher molecular weight polymers which comprise an amide unit, an N-oxide unit, or mixtures thereof, are useful for providing fabric abrasion reduction. The polymers of the present invention, herein described as "fabric abrasion reducing polymers, when applied to fabric provide a reduction in the amount of damage which is incurred by the fabric. Surprisingly, the fabric abrasion reducing polymers of the present invention comprise one or more units which in addition to fabric abrasion benefits, provides a dye transfer inhibition benefit. Therefore, the polymers of the present invention have a primary fabric abrasion benefit, and preferably a dye transfer inhibition benefit as well.

A first aspect of the present invention which relates fabric care compositions comprising:

a) from about 0.01%, preferably from about 0.1% to about 20%, preferably to about 10% by weight, of a fabric abrasion reducing polymer, said fabric abrasion polymer comprising:
   i) at least one monomeric unit comprising an amide moiety;
   ii) at least one monomeric unit comprising an N-oxide moiety;
   iii) and mixtures thereof; and
b) the balance carriers and adjunct ingredients;

provided the molecular weight of said fabric abrasion reducing polymer is greater than 100,000 daltons.

The present invention further relates to fabric care compositions which comprise:

a) from about 0.01%, preferably from about 0.1% to about 20%, preferably to about 10% by weight, of a fabric abrasion reducing polymer, said fabric abrasion polymer comprising:
   i) at least one monomeric unit comprising an amide moiety;
   ii) at least one monomeric unit comprising an N-oxide moiety;
   iii) and mixtures thereof;
b) optionally from about 1%, preferably from about 10%, more preferably from about 20% to about 80%, preferably to about 60%, more preferably to about 45% by weight, of a fabric softening active;
c) optionally less than about 15% by weight, of a principal solvent, preferably said principal solvent has a ClogP of from about 0.15 to about 1;
d) optionally from about 0.001% to about 90% by weight, of one or more dye fixing agents;
e) optionally from about 0.01% to about 50% by weight, of one or more cellulose reactive dye fixing agents;
f) optionally from about 0.01% to about 15% by weight, of a chlorine scavenger;
g) optionally about 0.005% to about 1% by weight, of one or more crystal growth inhibitors;
h) optionally from about 1% to about 12% by weight, of one or more liquid carriers;
i) optionally from about 0.001% to about 5% by weight, of an enzyme;
j) optionally from about 0.01% to about 8% by weight, of a polyolefin emulsion or suspension;
k) optionally from about 0.01% to about 0.2% by weight, of a stabilizer;
l) optionally from about 0.5% to about 5% by weight, of a cationic surfactant;
m) optionally from about 0.01% to about 50% by weight, of one or more linear or cyclic polyamines which provide bleach protection; and
o) the balance carrier and adjunct ingredients;

provided the molecular weight of said fabric abrasion reducing polymer is greater than 100,000 daltons.

The present invention relates to compositions which are laundry detergent composition, rinse-added fabric conditioning compositions, and dryer-added fabric conditioning compositions.

The present invention also relates to a method for providing reduced fabric abrasion to fabric, said method comprising the step of contacting said fabric with a composition which comprises from about 0.01% by weight, of the herein described fabric abrasion reducing polymer. These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

A BRIEF DESCRIPTION OF THE DRAWINGS

FIG. 1 is an example of a plot indicating the time delay (t-lag) in crystal formation afforded by a hypothetical crystal growth inhibitor.

DETAILED DESCRIPTION OF THE INVENTION

The present invention relates to compositions which when applied to fabric, reduce the fabric wear and enhance the fabric appearance. These benefits are provided by the surprising discovery that certain polymers which comprise an amide or N-oxide functional unit have fabric abrasion reduction benefits. Surprisingly, it has also been discovered that theses units also provide a secondary benefit; dye transfer inhibition. Therefore the compositions of the present invention provide not only fabric damage amelioration but also fabric color fidelity benefits.

The fabric care compositions of the present invention comprise one or more fabric abrasion reducing polymers as described herein. For the purposes of the present invention the term "fabric care compositions" is defined as "a composition which provides care to the fabric non-limiting examples of which include laundry detergent compositions, stand-alone compositions, detergent additives, fabric softening compositions inter alia rinse-added softening composition, dryer-added softening compositions". The compositions of the present invention provide an efficient fabric abrasion reduction. The term "efficient fabric abrasion reduction" is defined herein as "fabric which has been treated by the herein described compositions have an improved appearance relative to fabrics which have been un-treated by the herein disclosed compositions. The following describe the required elements of the present invention.

Fabric Abrasion Reducing Polymers

The compositions of the present invention comprise from about 0.01%, preferably from about 0.1% to about 20%, preferably to about 10% by weight, of a fabric abrasion reducing polymer.

The prefered reduced abrasion polymers of the present invention are water-soluble polymers. For the purposes of the present invention the term "water-soluble" is defined as "a polymer which when dissolved in water at a level of 0.2% by weight, or less, at 25° C., forms a clear, isotropic liquid".

The fabric abrasion reducing polymers useful in the present invention have the formula:

$$[\text{-P(D)}_m\text{-}]_n$$

wherein the unit P is a polymer backbone which comprises units which are homopolymeric or copolymeric. D units are defined herein below. For the purposes of the present invention the term "homopolymeric" is defined as "a polymer backbone which is comprised of units having the same unit composition, i.e., formed from polymerization of the same monomer". For the purposes of the present invention the term "copolymeric" is defined as "a polymer backbone which is comprised of units having a different unit composition, i.e., formed from the polymerization of two or more monomers".

P backbones preferably comprise units having the formula:

$$\text{—[CR}_2\text{—CR}_2\text{]— or —[(CR}_2)_x\text{-L]-}$$

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

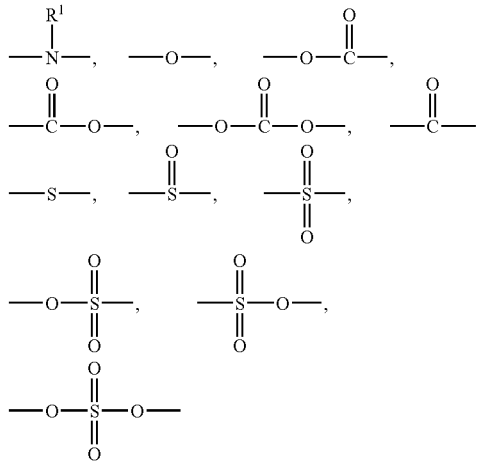

polysiloxane having the formula:

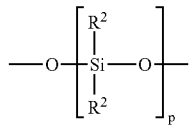

wherein the index p is from 1 to about 6; units which have dye transfer inhibition activity:

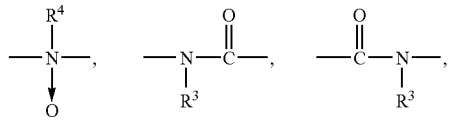

and mixtures thereof; wherein $R^1$ is hydrogen, $C_1$–$C_{12}$ alkyl, $C_6$–$C_{12}$ aryl, and mixtures thereof. $R^2$ is $C_1$–$C_{12}$ alkyl, $C_1$–$C_{12}$ alkoxy, $C_6$–$C_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the fabric abrasion reducing polymers of the present invention comprise one or more D units which are units which comprise one or more units which provide a dye transfer inhibiting benefit. The D unit can be part of the backbone itself as represented in the general formula:

$$[\text{-P(D)}_m\text{-}]_n$$

or the D unit may be incorporated into the backbone as a pendant group to a backbone unit having, for example, the formula:

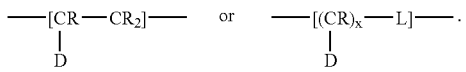

However, the number of D units depends upon the formulation. For example, the number of D units will be adjusted to provide water solubility of the polymer as well as efficacy of any optional dye transfer inhibition while providing a polymer which has fabric abrasion reducing properties. The molecular weight of the fabric abrasion reducing polymers of the present invention are from about 500, preferably from about 1,000, more preferably from about 100,000 most preferably from 160,000 to about 6,000,000, preferably to about 2,000,000, more preferably to about 1,000,000, yet more preferably to about 500,000, most preferably to about 360,000 daltons. Therefore the value of the index n is selected to provide the indicated molecular weight, and providing for a water solubility of least 100 ppm, preferably at least about 300 ppm, and more preferably at least about 1,000 ppm in water at ambient temperature which is defined herein as 25° C.

Polymers Comprising Amide Units

Non-limiting examples of preferred D units are D units which comprise an amide moiety. Examples of polymers wherein an amide unit is introduced into the polymer via a pendant group includes polyvinylpyrrolidone having the formula:

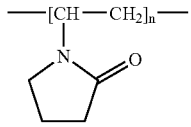

polyvinyloxazolidone having the formula:

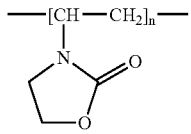

polyvinylmethyloxazolidone having the formula:

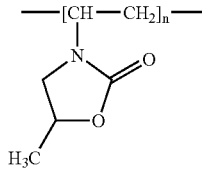

polyacrylamides and N-substituted polyacrylamides having the formula:

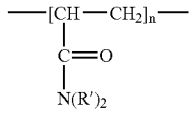

wherein each R' is independently hydrogen, $C_1$–$C_6$ alkyl, or both R' units can be taken together to form a ring comprising 4–6 carbon atoms; polymethacrylamides and N-substituted polymethacrylamides having the general formula:

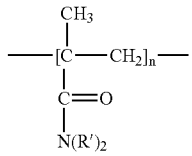

wherein each R' is independently hydrogen, $C_1$–$C_6$ alkyl, or both R' units can be taken together to form a ring comprising 4–6 carbon atoms; poly(N-acrylylglycinamide) having the formula:

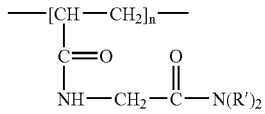

wherein each R' is independently hydrogen, $C_1$–$C_6$ alkyl, or both R' units can be taken together to form a ring comprising 4–6 carbon atoms; poly(N-methacrylylglycinamide) having the formula:

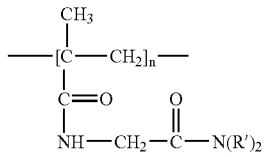

wherein each R' is independently hydrogen, $C_1$–$C_6$ alkyl, or both R' units can be taken together to form a ring comprising 4–6 carbon atoms; polyvinylurethanes having the formula:

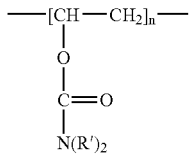

wherein each R' is independently hydrogen, $C_1$–$C_6$ alkyl, or both R' units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

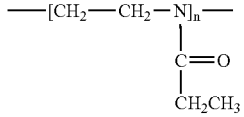

wherein the index n indicates the number of monomer residues present.

The fabric abrasion reducing polymers of the present invention can comprise any mixture of dye transfer inhibition units which provides the product with suitable properties.

The preferred polymers which comprise D units which are amide moieties are those which have the nitrogen atoms of the amide unit highly substituted so the nitrogen atoms are in effect shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamides. A detailed description of physicochemical properties of some of these polymers are given in "Water-Soluble Synthetic Polymers: Properties and Behavior", Philip Molyneux, Vol. I, CRC Press, (1983) included herein by reference.

The amide containing polymers may be present partially hydrolyzed and/or crosslinked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups, in the backbone and/or the ring, conferring hydrophobic properties. The rings may also provide planar alignment with the aromatic rings in the dye molecules. PVP is readily soluble in aqueous and organic solvent systems. PVP is available ex ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as shown below:

| | K-12 | K-15 | K-25 | K-30 | K-60 | K-90 |
|---|---|---|---|---|---|---|
| PVP viscosity average molecular weight (in thousands of daltons) | 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3 MM, commercially available ex Aldrich is also suitable for use herein. Yet further PVP-type of material suitable for use in the present invention are polyvinylpyrrolidone-co-dimethylaminoethylmethacrylate, commercially available commercially ex ISP in a quaternised form under the tradename Gafquat® or commercially available ex Aldrich Chemical Co. having a molecular weight of approximately 1.0 MM; polyvinylpyrrolidone-co-vinyl acetate, available ex BASF under the tradename Luviskol®, available in vinylpyrrolidone:vinylacetate ratios of from 3:7 to 7:3.

Polymers Comprising N-Oxide Units

Another D unit which provides dye transfer inhibition enhancement to the fabric abrasion reducing polymers described herein, are N-oxide units having the formula:

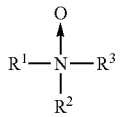

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyriding N-oxide, PVNO). In addition, the N-oxide unit may be pendant to the ring, for example, aniline oxide.

N-oxide comprising polymers of the present invention will preferably have a ration of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine N-oxides of the present invention have a $Pk_a$ less than or equal to 10, preferably less than or equal to 7, more preferably less than or equal to 6. The average molecular weight of the N-oxide comprising polymers which provide a dye transfer inhibitor benefit to reduced fabric abrasion polymers is from about 500 daltons, preferably from about 100,000 daltons, more preferably from about 160,000 daltons to about 6,000,000 daltons, preferably to about 2,000,000 daltons, more preferably to about 360,000 daltons.

Polymers Comprising Amide Units and N-Oxide Units

A further example of polymers which are fabric abrasion reducing polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

Molecular Weight

For all the above described polymers of the invention, it is most preferred that they have a molecular weight in the range as described herein above. This range is typically higher than the range for polymers which render only dye transfer inhibition benefits alone. Indeed, the higher molecular weight of the abrasion reducing polymers provides for reduction of fabric abrasion which typically occurs subsequent to treatment, for example during garment use, especially in a later washing procedure. Not to be bound by theory, it is believed that the high molecular weight enables the deposition of the polymer on the fabric surface and provides sufficient substantivity so that the polymer is capable of remaining on the fabric during subsequent use and subsequent laundering of the fabric. Further, it is believed that for a given charge density, increasing the molecular weight will increase the substantivity of the polymer to the fabric surface. Ideally the balance of charge density and molecular weight will provide both a sufficient rate of deposition onto the fabric surface and a sufficient attraction to the fabric during subsequent wash cycles. Increasing molecular weight is considered preferable to increasing charge density as it allows a greater choice in the range of materials which can provide the desired benefit and avoids the negative impact that increasing charge density may have inter alia the attraction of soil and residue onto treated fabrics. It should be noted, however, that a similar benefit may be predicted from the approach of increasing charge density while retaining a lower molecular weight material.

FABRIC CARE COMPOSITIONS

The present invention relates to fabric care compositions which comprise:

a) from about 0.01%, preferably from about 0.1% to about 20%, preferably to about 10% by weight, of a fabric abrasion reducing polymer, said fabric abrasion polymer comprising:
   i) at least one monomeric unit comprising an amide moiety;
   ii) at least one monomeric unit comprising an N-oxide moiety;
   iii) and mixtures thereof;
b) optionally from about 1%, preferably from about 10%, more preferably from about 20% to about 80%, preferably to about 60%, more preferably to about 45% by weight, of a fabric softening active;
c) optionally less than about 15% by weight, of a principal solvent, preferably said principal solvent has a ClogP of from about 0.15 to about 1;
d) optionally from about 0.001% to about 90% by weight, of one or more dye fixing agents;
e) optionally from about 0.01% to about 50% by weight, of one or more cellulose reactive dye fixing agents;
f) optionally from about 0.01% to about 15% by weight, of a chlorine scavenger;
g) optionally about 0.005% to about 1% by weight, of one or more crystal growth inhibitors;
h) optionally from about 1% to about 12% by weight, of one or more liquid carriers;
i) optionally from about 0.001% to about 5% by weight, of an enzyme;
j) optionally from about 0.01% to about 8% by weight, of a polyolefin emulsion or suspension;
k) optionally from about 0.01% to about 0.2% by weight, of a stabilizer;
l) optionally from about 0.5% to about 5% by weight, of a cationic surfactant;
m) from about 0.01% by weight, of one or more linear or cyclic polyamines which provide bleach protection; and
o) the balance carrier and adjunct ingredients;

provided the molecular weight of said fabric abrasion reducing polymer is greater than 100,000 daltons.

The following are non-limiting examples of ingredients which can be combined with the amide-containing, N-oxide-containing, and combination thereof polymers of the present invention.

Dye Fixing Agents

The compositions of the present invention optionally comprise from about 0.001%, preferably from about 0.5% to about 90%, preferably to about 50%, more preferably to about 10%, most preferably to about 5% by weight, of one or more dye fixing agents.

Dye fixing agents, or "fixatives", are well-known, commercially available materials which are designed to improve the appearance of dyed fabrics by minimizing the loss of dye from fabrics due to washing. Not included within this definition are components which can in some embodiments serve as fabric softener actives.

Many dye fixing agents are cationic, and are based on quaternized nitrogen compound or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E-50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) ex Sandoz, REWIN SRF, REWIN SRF-O and REWIN DWR ex CHT-Beitlich GMBH; Tinofix® ECO, Tinofix® FRD and Solfin® ex Ciba-Geigy. A preferred dye fixing agent for use in the compositions of the present invention is CARTAFIX CB® ex Clariant.

Other cationic dye fixing agents are described in "After-treatments for Improving the Fastness of Dyes on Textile Fibres", Christopher C. Cook, *Rev. Prog. Coloration*, Vol. XII, (1982). Dye fixing agents suitable for use in the present invention are ammonium compounds such as fatty acid-diamine condensates inter alia the hydrochloride, acetate, metosulphate and benzyl hydrochloride salts of diamine esters. Non-limiting examples include oleyldiethyl aminoethylamide, oleylmethyl diethylenediamine methosulphate, monostearylethylene diaminotrimethylammonium methosulphate. In addition, the N-oxides of tertiary amines;

derivatives of polymeric alkyldiamines, polyamine-cyanuric chloride condensates, and aminated glycerol dichlorohydrins are suitable for use as dye fixatives in the compositions of the present invention.

Cellulose Reactive Dye Fixing Agents

Another dye fixing agent suitable for use in the present invention are cellulose reactive dye fixing agents. The compositions of the present invention optionally comprise from about 0.01%, preferably from about 0.05%, more preferably from about 0.5% to about 50%, preferably to about 25%, more preferably to about 10% by weight, most preferably to about 5% by weight, of one or more cellulose reactive dye fixing agents. The cellulose reactive dye fixatives may be suitably combined with one or more dye fixatives described herein above in order to comprise a "dye fixative system".

The term "cellulose reactive dye fixing agent" is defined herein as "a dye fixative agent which reacts with the cellulose fibers upon application of heat or upon a heat treatment either in situ or by the formulator". The cellulose reactive dye fixing agents suitable for use in the present invention can be defined by the following test procedure.

Cellulose Reactivity Test (CRT)

Four pieces of fabric which are capable of bleeding their dye (e.g. 10×10 cm of knitted cotton dyed with Direct Red 80) are selected. Two swatches are used as a first control and a second control, respectively. The two remaining swatches are soaked for 20 minutes in an aqueous solution containing 1% (w/w) of the cellulose reactive dye fixing agent to be tested. The swatches are removed and thoroughly dried. One of the treated swatches which has been thoroughly dried, is passed ten times through an ironing calender which is adjusted to a "linen fabric" temperature setting. The first control swatch is also passed ten times through an ironing calender on the same temperature setting.

All four swatches (the two control swatches and the two treated swatches, one of each which has been treated by the ironing calender) are washed separately in Launder-O-Meter pots under typical conditions with a commercial detergent used at the recommended dosage for ½ hour at 60° C., followed by a thorough rinsing of 4 times 200 ml of cold water and subsequently line dried.

Color fastness is then measured by comparing the DE values of a new untreated swatch with the four swatches which have undergone the testing. DE values, the computed color difference, is defined in ASTM D2244. In general, DE values relate to the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space. For the purposes of the present invention, the lower the DE value for a sample, the closer the sample is to the untested sample and the greater the color fastness benefit.

As the test relates to selection or a cellulose reactive dye fixing agent, if the DE value for the swatch treated in the ironing step has a value which is better than the two control swatches, the candidate is a cellulose reactive dye fixing agent for the purposes of the invention.

Typically cellulose reactive dye fixing agents are compounds which contain a cellulose reactive moiety, non limiting examples of these compounds include halogenotriazines, vinyl sulphones, epichlorhydrine derivatives, hydroxyethylene urea derivatives, formaldehyde condensation products, polycarboxylates, glyoxal and glutaraldehyde derivatives, and mixtures thereof. Further examples can be found in "Textile Processing and Properties", Tyrone L. Vigo, at page 120 to 121, Elsevier (1997), which discloses specific electrophilic groups and their corresponding cellulose affinity.

Preferred hydroxyethylene urea derivatives include dimethyloldihydroxyethylene, urea, and dimethyl urea glyoxal. Preferred formaldehyde condensation products include the condensation products derived from formaldehyde and a group selected from an amino-group, an imino-group, a phenol group, an urea group, a cyanamide group and an aromatic group. Commercially available compounds among this class are Sandofix WE 56 ex Clariant, Zetex E ex Zeneca and Levogen BF ex Bayer. Preferred polycarboxylates derivatives include butane tetracarboxilic acid derivatives, citric acid derivatives, polyacrylates and derivatives thereof. A most preferred cellulosic reactive dye fixing agents is one of the hydroxyethylene urea derivatives class commercialized under the tradename of Indosol CR ex Clariant. Still other most preferred cellulosic reactive dye fixing agents are commercialized under the tradename Rewin DWR and Rewin WBS ex CHT R. Beitlich.

Chlorine Scavengers

The compositions of the present invention optionally comprise from about 0.01%, preferably from about 0.02%, more preferably from about 0.25% to about 15%, preferably to about 10%, more preferably to about 5% by weight, of a chlorine scavenger. In cases wherein the cation portion and the anion portion of the non-polymeric scavenger each react with chlorine, the amount of scavenger can be adjusted to fit the needs of the formulator.

Suitable chlorine scavengers include ammonium salts having the formula:

$$[(R)_3R^1N]^+X^-$$

wherein each R is independently hydrogen, $C_1$–$C_4$ alkyl, $C_1$–$C_4$ substituted alkyl, and mixtures thereof, preferably R is hydrogen or methyl, more preferably hydrogen. $R^1$ is hydrogen $C_1$–$C_9$ alkyl, $C_1$–$C_9$ substituted alkyl, and mixtures thereof, preferably R is hydrogen. X is a compatible anion, non-limiting examples include chloride, bromide, citrate, sulfate; preferably X is chloride.

Non-limiting examples of preferred chlorine scavengers include ammonium chloride, ammonium sulfate, and mixtures thereof; preferably ammonium chloride.

Crystal Growth Inhibitor

The compositions of the present invention optionally comprise from about 0.005%, preferably from about 0.5%, more preferably from about 0.1% to about 1%, preferably to about 0.5%, more preferably to about 0.25%, most preferably to about 0.2% by weight, of one or more crystal growth inhibitors. The following "Crystal Growth Inhibition Test" is used to determine the suitability of a material for use as a crystal growth inhibitor.

Crystal Growth Inhibition Test (CGIT)

The suitability of a material to serve as a crystal growth inhibitor according to the present invention can be determined by evaluating in vitro the growth rate of certain inorganic micro-crystals. The procedure of Nancollas et al., described in "Calcium Phosphate Nucleation and Growth in Solution", *Prog. Crystal Growth Charact.*, Vol 3, 77–102, (1980), incorporated herein by reference, is a method which is suitable for evaluating compounds for their crystal growth inhibition. The graph provided as FIG. 1 serves as an example of a plot indicating the time delay (t-lag) in crystal formation afforded by a hypothetical crystal growth inhibitor.

The observed t-lag provides a measure of the compound's efficiency with respect to delaying the growth of calcium phosphate crystal. The greater the t-lag, the more efficient the crystal growth inhibitor.

Exemplary Procedure

Combine in a suitable vessel, 2.1M KCl (35 mL), 0.0175M $CaCl_2$ (50 mL), 0.01M $KH_2PO_4$ (50 mL), and de-ionized water (350 mL). A standard pH electrode equipped with a Standard Calomel Reference electrode is inserted and the temperature adjusted to 37° C. while purging of the solution of oxygen. Once the temperature and pH are stabilized, a solution of the crystal growth inhibitor to be test is then added. A typical inhibitor test concentration is $1\times10^{-6}$ M. The solution is titrated to pH 7.4 with 0.05M KOH. The mixture is then treated with 5 mL's of a hydroxyapatite slurry. The hydroxyapatite slurry can be prepared by digesting Bio-Gel® HTP hydroxyapatite powder (100 g) in 1 L of distilled water the pH of which is adjusted to 2.5 by the addition of sufficient 6N HCl and subsequently heating the solution until all of the hydroxyapatite is dissolved (heating for several days may be necessary). The temperature of the solution is then maintained at about 22° C. while the pH is adjusted to 12 by the addition of a solution of 50% aqueous KOH. Once again the solution is heated and the resulting slurry is allowed to settle for two days before the supernatant is removed. 1.5 L of distilled water is added, the solution stirred, then after settling again for 2 days the supernatant is removed. This rinsing procedure is repeated six more time after which the pH of the solution is adjusted to neutrality using 2N HCl. The resulting slurry can be stored at 37° C. for eleven months.

Crystal growth inhibitors which are suitable for use in the present invention have a t-lag of at least 10 minutes, preferably at least 20 minutes, more preferably at least 50 minutes, at a concentration of $1\times10^{-6}$M. Crystal growth inhibitors are differentiated form chelating agents by the fact that crystal growth inhibitors have a low binding affinity of heavy metal ions, i.e., copper. For example, crystal growth inhibitors have an affinity for copper ions in a solution of 0.1 ionic strength when measured at 25° C., of less than 15, preferably less than 12.

The preferred crystal growth inhibitors of the present invention are selected from the group consisting of carboxylic compounds, organic diphosphonic acids, and mixtures thereof. The following are non-limiting examples of preferred crystal growth inhibitors.

Carboxylic Compounds

Non-limiting examples of carboxylic compounds which serve as crystal growth inhibitors include glycolic acid, phytic acid, polycarboxylic acids, polymers and copolymers of carboxylic acids and polycarboxylic acids, and mixtures thereof. The inhibitors may be in the acid or salt form. Preferably the polycarboxylic acids comprise materials having at least two carboxylic acid radicals which are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. No. 3,128,287, U.S. Pat. No. 3,635,830, U.S. Pat. No. 4,663,071, U.S. Pat. No. 3,923,679; U.S. Pat. No. 3,835,163; U.S. Pat. No. 4,158,635; U.S. Pat. No. 4,120,874 and U.S. Pat. No. 4,102,903, each of which is included herein by reference.

Further suitable polycarboxylates include ether hydroxypolycarboxylates, polyacrylate polymers, copolymers of maleic anhydride and the ethylene ether or vinyl methyl ethers of acrylic acid. Copolymers of 1,3,5-trihydroxybenzene, 2,4,6-trisulphonic acid, and carboxymethyloxysuccinic acid are also useful. Alkali metal salts of polyacetic acids, for example, ethylenediamine tetraacetic acid and nitrilotriacetic acid, and the alkali metal salts of polycarboxylates, for example, mellitic acid, succinic acid, oxydisuccinic acid, polymaleic acid, benzene 1,3,5-tricarboxylic acid, carboxymethyloxysuccinic acid, are suitable for use in the present invention as crystal growth inhibitors.

The polymers and copolymers which are useful as crystal growth inhibitors have a molecular weight which is preferably greater than about 500 daltons to about 100,000 daltons, more preferably to about 50,000 daltons.

Examples of commercially available materials for use as crystal growth inhibitors include, polyacrylate polymers Good-Rite® ex BF Goodrich, Acrysol® ex Rohm & Haas, Sokalan® ex BASF, and Norasol® ex Norso Haas. Preferred are the Norasol® polyacrylate polymers, more preferred are Norasol® 410N (MW 10,000) and Norasol® 440N (MW 4000) which is an amino phosphonic acid modified polyacrylate polymer, and also more preferred is the acid form of this modified polymer sold as Norasol® QR 784 (MW 4000) ex Norso-Haas.

Polycarboxylate crystal growth inhibitors include citrates, e.g., citric acid and soluble salts thereof (particularly sodium salt), 3,3-dicarboxy-4-oxa-1,6-hexanedioates and related compounds further disclosed in U.S. Pat. No. 4,566,984 incorporated herein by reference, $C_5$–$C_{20}$ alkyl, $C_5$–$C_{20}$ alkenyl succinic acid and salts thereof, of which dodecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. No. 4,144,226, U.S. Pat. No. 3,308,067 and U.S. Pat. No. 3,723,322, all of which are incorporated herein by reference.

Organic Phosphonic Acids

Organic diphosphonic acid are also suitable for use as crystal growth inhibitors. For the purposes of the present invention the term "organic diphosphonic acid" is defined as "an organo-diphosphonic acid or salt which does not comprise a nitrogen atom". Preferred organic diphosphonic acids include $C_1$–$C_4$ diphosphonic acid, preferably $C_2$ diphosphonic acid selected from the group consisting of ethylene diphosphonic acid, α-hydroxy-2 phenyl ethyl diphosphonic acid, methylene diphosphonic acid, vinylidene-1,1-diphosphonic acid, 1,2-dihydroxyethane-1,1-diphosphonic acid, hydroxy-ethane 1,1 diphosphonic acid, the salts thereof, and mixtures thereof. More preferred is hydroxyethane-1,1-diphosphonic acid (HEDP). A preferred is phosphonic acid is 2-phosphonobutane-1,2,4-tricarboxylic acid available as BAYHIBIT AM® ex Bayer.

Fabric Softening Actives

The compositions of the present invention optionally comprise at least about 1%, preferably from about 10%, more preferably from about 20% to about 80%, more preferably to about 60%, most preferably to about 45% by weight, of the composition of one or more fabric softener actives.

The preferred fabric softening actives according to the present invention are amines having the formula:

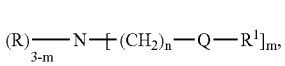

quaternary ammonium compounds having the formula:

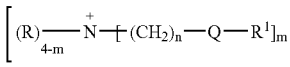

and mixtures thereof, wherein each R is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

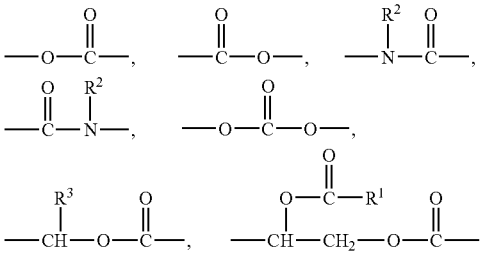

wherein $R^2$ is hydrogen, $C_1$–$C_4$ alkyl, preferably hydrogen; $R^3$ is $C_1$–$C_4$ alkyl, preferably hydrogen or methyl; preferably Q has the formula:

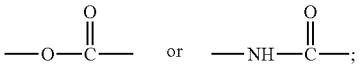

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X^{(-)}$ represents half a group. The index m has a value of from 1 to 3; the index n has a value of from 1 to 4, preferably 2 or 3, more preferably 2.

One embodiment of the present invention provides for amines and quaternized amines having two or more different values for the index n per molecule, for example, a softener active prepared from the starting amine methyl(3-aminopropyl)(2-hydroxyethyl)amine.

More preferred softener actives according to the present invention have the formula:

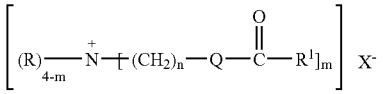

wherein the unit having the formula:

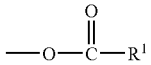

is a fatty acyl moiety. Suitable fatty acyl moieties for use in the softener actives of the present invention are derived from sources of triglycerides including tallow, vegetable oils and/or partially hydrogenated vegetable oils including inter alia canola oil, safflower oil, peanut oil, sunflower oil, corn oil, soybean oil, tall oil, rice bran oil. Yet more preferred are the Diester Quaternary Ammonium Compounds (DEQA's) wherein the index m is equal to 2.

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

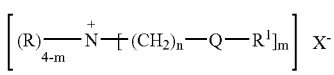

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed. A further preferred embodiment of the present invention comprises DEQA's wherein the average Iodine Value for $R^1$ is approximately 45.

The $R^1$ units suitable for use in the isotropic liquids present invention can be further characterized in that the Iodine Value (IV) of the parent fatty acid, said IV is preferably from about 10, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active.

A prefered source of fatty acyl units, especially fatty acyl units having branching, for example, "Guerbet branching", methyl, ethyl, etc. units substituted along the primary alkyl chain, synthetic sources of fatty acyl units are also suitable. For example, the formulator may with to add one or more fatty acyl units having a methyl branch at a "non-naturally occuring" position, for example, at the third carbon of a $C_{17}$ chain. What is meant herein by the term "non-naturally occuring" is "acyl units which are not found in significant (greater than about 0.1%) quantities is common fats and oils which serve as feedstocks for the source of triglycerides described herein." If the desired branched chain fatty acyl unit is unavailable from readily available natural feedstocks, therefore, synthetic fatty acid can be suitably admixed with other synthetic materials or with other natural triglyceride derived sources of acyl units.

The following are examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium methyl sulfate;

N,N-di(canolyl-oxy-ethyl)-N-methyl, N-(2-hydroxyethyl) ammonium methyl sulfate;

N,N-di(tallowylamidoethyl)-N-methyl, N-(2-hydroxyethyl) ammonium methyl sulfate;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride;

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tri(canolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dimethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21, 1975; and European Patent Application publication No. 472,178, by Yamamura et al., all of said documents being incorporated herein by reference.

Principal Solvent

The compositions of the present invention, preferably the isotropic liquid embodiments thereof, may also optionally comprise a principal solvent. The level of principal solvent present in the compositions of the present invention is typically less than about 95%, preferably less than about 50%, more preferably less than about 25%, most preferably less than about 15% by weight. Some embodiments of isotropic liquid embodiments of the present invention may comprise no principal solvent but may substitute instead a suitable nonionic surfactant.

The principal solvents of the present invention are primarily used to obtain liquid compositions having sufficient clarity and viscosity. Principal solvents must also be selected to minmize solvent odor impact in the composition. For example, isopropyl alcohol is not an effective principal solvent in that it does not serve to produce a composition having suitable viscosity. Isopropanol also fails as a suitable principal solvent because it has a relatively strong odor.

Principal solvents are also selected for their ability to provide stable compositions at low temperatures, preferably compositions comprising suitable principal solvents are clear down to about 4° C. and have the ability to fully recover their clarity if stored as low as about 7° C.

The principal solvents according to the present invention are selected base upon their octanol/water partition coefficient (P). The octanol/water partition coefficient is a measure of the ratio of the concentrations of a particular principal solvent in octanol and water at equilibrium. The partition coefficients are conveniently expressed and reported as their logarithm to the base 10; logP.

The logP of many principal solvent species has been reported; for example, the Ponmona92 database, available from Daylight Chemical Information Systems, Inc.(Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each HR species, and takes into account the numbers and types of atoms, the atom connectivity, and chemical bonding. ClogP values are the most reliable and widely used estimates for octanol water partitioning. It will be understood by those skilled in the art that experimental log P values could also be used. Experimental log P values represent a less preferred embodiment of the invention. Where experimental log P values are used, the one hour log P values are preferred. Other methods that can be used to compute ClogP include, e.g., Crippen's fragmentation method as disclosed in *J. Chem. Inf. Comput. Sci.,* 27a,21 (1987); Viswanadhan's fragmentation method as disclosed in *J. Chem. Inf Comput. Sci.,* 29, 163 (1989); and Broto's method as disclosed in *Eur. J. Med. Chem.-Chim. Theor.,* 19, 71 (1984).

The principal solvents suitable for use in the present invention are selected from those having a ClogP of from about 0.15 to about 1, preferably from about 0.15 to about 0.64, more preferably from about 0.25 to about 0.62, most preferably form about 0.4 to about 0.6. Preferably the principal solvent is at least to some degree an asymmetric molecule, preferably having a melting, or solidification point which allows the principal solvent to be liquid at or near room temperature. Low molecular weight principal solvents may be desirable for some embodiments. More preferred molecules are highly asymmetrical.

A further description of principal solvents suitable for use in the isotropic liquid compositions of the present invention are thoroughly described in WO 97/03169 "Concentrated, Stable Fabric Softening Composition", published Jan. 30, 1997 and assigned to the Procter & Gamble Co.; WO 97/03170 "Concentrated, Water Dispersible, Stable, Fabric Softening Composition", published Jan. 30, 1997 and assigned to the Procter & Gamble Co.; and WO 97/34972 "Fabric Softening Compound/Composition", published Sep. 25, 1997 and assigned to the Procter & Gamble Co. all included herein by reference.

Hydrophobic Dispersant

A preferred composition of the present invention comprises from about 0.1%, preferably from about 5%, more preferably form about 10% to about 80%, preferably to about 50%, more preferably to about 25% by weight, of a hydrophobic polyamine dispersant having the formula:

$$[(R^1)_2N-R]_w[\overset{R^1}{\overset{|}{N}}-R]_x[\overset{B}{\overset{|}{N}}-R]_y[N(R^1)_2$$

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

$$-(CH_2CHR'O)_m(CH_2CH_2O)_nH$$

wherein R' is methyl or ethyl, m and n are preferably from about 0 to about 50, provided the average value of alkoxylation provided by m+n is at least about 0.5.

A further description of polyamine dispersants suitable for use in the present invention is found in U.S. Pat. No. 4,891,160 Vander Meer, issued Jan. 2, 1990; U.S. Pat. No. 4,597,898, Vander Meer, issued Jul. 1, 1986; European Patent Application 111,965, Oh and Gosselink, published Jun. 27, 1984; European Patent Application 111,984, Gosselink, published Jun. 27, 1984; European Patent Application 112,592, Gosselink, published Jul. 4, 1984; U.S. Pat. No. 4,548,744, Connor, issued Oct. 22, 1985; and U.S. Pat. No. 5,565,145 Watson et al., issued Oct. 15, 1996; all of which are included herein by reference. However, any suitable clay/soil dispersent or anti-redepostion agent can be used in the laundry compositions of the present invention.

Electrolyte

The fabric softening embodiments of the compositions of the present invention, especially clear, isotropic liquid fabric softening compositions, may also optionally, but preferably comprise, one or more electrolytes for control of phase stability, viscosity, and/or clarity. For example, the presence of certain electrolytes inter alia calcium chloride, magnesium chloride may be key to insuring initial product clarity and low viscosity, or may affect the dilution viscosity of liquid embodiments, especially isotropic liquid embodiments. Not wishing to be limited by theory, but only wishing to provide an example of a circumstance wherein the formulator must insure proper dilution viscosity, includes the following example. Isotropic or non-isotropic liquid fabric softener compositions can be introduced into the rinse phase of laundry operations via an article of manufacture designed to dispense a measured amount of said composition. Typically the article of manufacture is a dispenser which delivers the softener active only during the rinse cycle. These dispensers are typically designed to allow an amount of water equal to the volume of softener composition to enter into the dispenser to insure complete delivery of the softener composition. An electrolyte may be added to the compositions of the present invention to insure phase stability and prevent the diluted softener composition from "gelling out" or from undergoing an undesirable or unacceptable viscosity increase. Prevention of gelling or formation of a "swelled", high viscosity solution insures thorough delivery of the softener composition.

However, those skilled in the art of fabric softener compositions will recognize that the level of electrolyte is also influenced by other factors inter alia the type of fabric softener active, the amount of principal solvent, and the level and type of nonionic surfactant. For example, triethanol amine derived ester quaternary amines suitable for use as softener actives according to the present invention are typically manufactured in such a way as to yield a distribution of mono-, di-, and tri-esterified quaternary ammonium compounds and amine precursors. Therefore, as in this example, the variability in the distribution of mono-, di-, and tri-esters and amines may predicate a different level of electrolyte. Therefore, the formulator must consider all of the ingredients, namely, softener active, nonionic surfactant, and in the case of isotropic liquids, the principal solvent type and level, as well as level and identity of adjunct ingredients before selecting the type and/or level of electrolyte A wide variety of ionizable salts can be used. Examples of suitable salts are the halides of the Group IA and IIA metals of the Periodic Table of the elements, e.g., calcium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 5,000 ppm, of the composition.

Alkylene polyammonium salts can be incorporated into the composition to give viscosity control in addition to or in place of the water-soluble, ionizable salts above, In addition, these agents can act as scavengers, forming ion pairs with anionic detergent carried over from the main wash, in the rinse, and on the fabrics, and can improve softness performance. These agents can stabilized the viscosity over a broader range of temperature, especially at low temperatures, compared to the inorganic electrolytes. Specific examples of alkylene polyammonium salts include L-lysine, monohydrochloride and 1,5-diammonium 2-methyl pentane dihydrochloride.

Enzymes

The compositions and processes herein can optionally employ one or more enzymes inter alia lipases, proteases, cellulase, amylases, mannanases, xyloglucanases, and peroxidases. A preferred enzyme for use herein is cellulase enzyme. Cellulases usable for use in the fabric enhancement compositions of the present invention include both bacterial and fungal types which preferably exhibit an optimal performance at a pH of from 5 to 9.5. U.S. Pat. No. 4,435,307 Barbesgaard et al., issued Mar. 6, 1984, included herein by reference, discloses suitable fungal cellulases ex *Humicola insolens* or *Humicola* strain DSM1800 or a cellulase 212-producing fungus belonging to the genus *Aeromonas*, and cellulase enzymes extracted from the hepatopancreas of a marine mollusk, *Dolabella Auricula Solander*. Suitable cellulases are also disclosed in GB-A-2.075.028; GB-A-2.095.275 and DE-OS-2.247.832 each of which is included herein by reference. CAREZYME® and CELLUZYME® (Novo) are especially useful. Other suitable cellulases are also disclosed in WO 91/17243 to Novo, WO 96/34092, WO 96/34945 and EP-A-0,739,982. Compositions may comprise up to 5 mg by weight, more typically 0.01 mg to 3 mg, of active enzyme per gram of the composition. Stated otherwise, the compositions herein will typically comprise from 0.001%, preferably from 0.01% to 5%, preferably to 1% by weight, of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Cationic Charge Boosters

The compositions or the present invention may optionally comprise one or more cationic charge boosters, especially to the rinse-added fabric softening embodiments of the present invention. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition. This is especially true in clear, translucent, isotropic compositions.

The preferred cationic charge boosters of the present invention are described herein below.

i) Quaternary Ammonium Compounds

An optional composition of the present invention comprises at least about 0.2%, preferably from about 0.2% to about 10%, more preferably from about 0.2% to about 5% by weight, of a cationic charge booster having the formula:

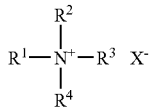

wherein $R^1$, $R^2$, $R^3$, and $R^4$ are each independently $C_1$–$C_{22}$ alkyl, $C_3$–$C_{22}$ alkenyl, $R^5$-Q-$(CH_2)_m$—, wherein $R^5$ is $C_1$–$C_{22}$ alkyl, and mixtures thereof, m is from 1 to about 6; X is an anion.

Preferably $R^1$ is $C_6$–$C_{22}$ alkyl, $C_6$–$C_{22}$ alkenyl, and mixtures thereof, more preferably $C_{11}$–$C_{18}$ alkyl, $C_{11}$–$C_{18}$ alkenyl, and mixtures thereof; $R^2$, $R^3$, and $R^4$ are each preferably $C_1$–$C_4$ alkyl, more preferably each $R^2$, $R^3$, and $R^4$ are methyl.

The formulator may similarly choose $R^1$ to be a $R^5$-Q-$(CH_2)_m$— moiety wherein $R^5$ is an alkyl or alkenyl moiety having from 1 to 22 carbon atoms, preferably the alkyl or alkenyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$-Q-$(CH_2)_m$— moiety has the formula:

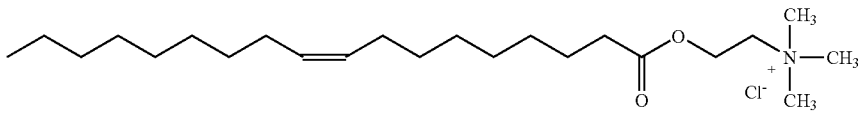

wherein $R^5$-Q- is an oleoyl units and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

ii) Polyvinyl Amines

A preferred embodiment of the present invention contains at least about 0.2%, preferably from about 0.2% to about 5%, more preferably from about 0.2% to about 2% by weight, of one or more polyvinyl amines having the formula

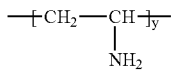

wherein y is from about 3 to about 10,000, preferably from about 10 to about 5,000, more preferably from about 20 to about 500. Polyvinyl amines suitable for use in the present invention are available from BASF.

Optionally, one or more of the polyvinyl amine backbone —$NH_2$ unit hydrogens can be substituted by an alkyleneoxy unit having the formula:

$$-(R^1O)_xR^2$$

wherein $R^1$ is $C_2$–$C_4$ alkylene, $R^2$ is hydrogen, $C_1$–$C_4$ alkyl, and mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

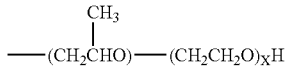

wherein x has the value of from 1 to about 50. Substitutions such as the above are represented by the abbreviated formula PO-$EO_x$-. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

iii) Poly-Quaternary Ammonium Compounds

A preferred composition of the present invention comprises at least about 0.2%, preferably from about 0.2% to about 10%, more preferably from about 0.2% to about 5% by weight, of a cationic charge booster having the formula:

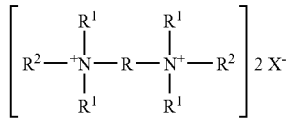

wherein R is substituted or unsubstituted $C_2$–$C_{12}$ alkylene, substituted or unsubstituted $C_2$–$C_{12}$ hydroxyalkylene; each $R^1$ is independently $C_1$–$C_4$ alkyl, each $R^2$ is independently $C_1$–$C_{22}$ alkyl, $C_3$–$C_{22}$ alkenyl, $R^5$-Q-$(CH_2)_m$—, wherein $R^5$ is $C_1$–$C_{22}$ alkyl, $C_3$–$C_{22}$ alkenyl, and mixtures thereof; m is from 1 to about 6; Q is a carbonyl unit as defined hereinabove; and mixtures thereof; X is an anion.

Preferably R is ethylene; $R^1$ is methyl or ethyl, more preferably methyl; at least one $R^2$ is preferably $C_1$–$C_4$ alkyl, more preferably methyl. Preferably at least one $R^2$ is $C_{11}$–$C_{22}$ alkyl, $C_{11}$–$C_{22}$ alkenyl, and mixtures thereof.

The formulator may similarly choose $R^2$ to be a $R^5$-Q-$(CH_2)_m$— moiety wherein $R^5$ is an alkyl moiety having from 1 to 22 carbon atoms, preferably the alkyl moiety when taken together with the Q unit is an acyl unit derived preferably derived from a source of triglyceride selected from the group consisting of tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures thereof.

An example of a fabric softener cationic booster comprising a $R^5$-Q-$(CH_2)_m$— moiety has the formula:

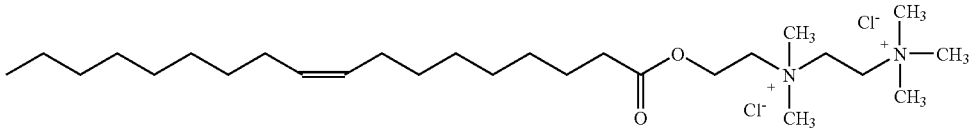

wherein $R^1$ is methyl, one $R^2$ units is methyl and the other $R^2$ unit is $R^5$-Q-$(CH_2)_m$— wherein $R^5$-Q- is an oleoyl unit and m is equal to 2.

X is a softener compatible anion, preferably the anion of a strong acid, for example, chloride, bromide, methylsulfate, ethylsulfate, sulfate, nitrate and mixtures thereof, more preferably chloride and methyl sulfate.

Dispersibility Aids

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1)

single long chain alkyl cationic surfactants; (2) nonionic surfactants; (3) amine oxides; (4) fatty acids; and (5) mixtures thereof. These aids are described in P&G Copending application Ser. No. 08/461,207, filed Jun. 5, 1995, Wahl et al., specifically on page 14, line 12 to page 20, line 12, which is herein incorporated by reference.

Preferred dispersibility aids are GENAMINE® and GENAPOL® ex Clariant. When PVP is present in the compositions of the present invention, a preferred embodiment comprises both a cocoyl ethoxylated amine and a cocoyl ethoxylated alcohol, wherein the ethoxylation is approximately 10, each of which are available as GENAMINE® and GENAPOL®. A preferred example of the use of this admixture is a composition which compries, for example, 0.2% GENAMINE® and 0.1% GENAPOL®.

When said dispersibility aids are present, the total level is from 0.1%, preferably from 0.3%, more preferably from 3%, even more preferably from 4%, and most preferably from 5% to 25%, preferably to 17%, more preferably to 15%, most preferably to 13% by weight, of the composition. These materials can either be added as part of the active softener raw material, e.g., the mono-long chain alkyl cationic surfactant and/or the fatty acid which are reactants used to form the fabric softener active as discussed hereinbefore, or added as a separate component. The total level of dispersibility aid includes any amount that may be present as part of the softener active.

Soil Release Agents

Particular to the embodiments of the rinse-added fabric softeners according to the present invention, certain soil release agents provide not only the below described soil release properties but are added for their suitability in maintaining proper viscosity, especially in the dispersed phase, non-isotropic compositions.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the rinsing cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the detergent compositions herein, typically from about 0.1% to about 5%, preferably from about 0.2% to about 3.0%.

The following, all included herein by reference, describe soil release polymers suitable for us in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,721,580 Gosselink issued Jan. 26, 1988; U.S. Pat. No. 4,702,857 Gosselink, issued Oct. 27, 1987; U.S. Pat. No. 4,711,730 Gosselink et al., issued Dec. 8, 1987; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N.V., 1974; all incorporated herein by reference.

Bleach Protection Polyamines

The compositions of the present invention optionally comprise from about 0.01%, preferably from about 0.75%, more preferably from 10%, most preferably from about 15% to about 50%, preferably to about 35%, more preferably to about 30%, most preferably to about 5% by weight, of one or more linear or cyclic polyamines which provide bleach protection.

Linear Polyamines

The bleach protection polyamines of the present invention have the formula:

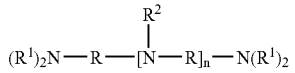

wherein R is 1,2-propylene, 1,3-propylene, and mixtures thereof; preferably 1,3-propylene. Each $R^1$ is independently hydrogen, methyl, ethyl, or an alkyleneoxy unit having the formula:

$$—(R^3O)—R^4$$

wherein $R^3$ is ethylene, 1,2-propylene, 1,2-butylene, or mixtures thereof; preferably $R^3$ is ethylene or 1,2-propylene, more preferably 1,2-propylene. $R^4$ is hydrogen, $C_1$–$C_4$ alkyl, and mixtures thereof; preferably hydrogen. $R^1$ may comprise any mixture of alkyleneoxy units. $R^2$ is hydrogen, $R^1$, $—RN(R^1)_2$, and mixtures thereof; preferably at least one $R^2$ is hydrogen when n is equal to 2. The integer n is 1 or 2. For "peralkylated" amines each $R^1$ and $R^2$ will be independently selected from methyl or ethyl.

A prefered bleach protection linear polyamine has a backbone wherein R is 1,3-propylene, $R^2$ is hydrogen, or alkoxy, and n is equal to 2 is N,N'-bis(3-aminopropyl)-1,3-propylenediamine (TPTA). For certain formulations, polyamines which comprise alkylated polyamines are preferred, for example, tetramethyl dipropylenetriamine, permethylated dipropylenetriamine, mono-methylated dipropylenetriamine.

Cyclic Amines

The bleach protection cyclic polyamines of the present invention comprise polyamine backbones having the formula:

R-L-R wherein L is a linking unit, said linking unit comprising a ring having at least 2 nitrogen atoms; R is hydrogen, $—(CH_2)_kN(R^1)_2$, and mixtures thereof; wherein each index k independently has the value from 2 to 4, preferably 3. Preferably the backbone of the cyclic amines including R units is 200 daltons or less.

Each $R^1$ is independently hydrogen, $C_1$–$C_2$ alkyl, or an alkyleneoxy unit having the formula:

$$—(R^3O)—R^4$$

wherein $R^3$ is ethylene, 1,2-propylene, 1,2-butylene, or mixtures thereof; preferably $R^3$ is ethylene or 1,2-propylene, more preferably 1,2-propylene. $R^4$ is hydrogen, $C_1$–$C_4$ alkyl, and mixtures thereof; preferably hydrogen. $R^1$ may comprise any mixture of alkyleneoxy units.

Preferred polyamines of the present invention have the formula:

$$(R^1)_2N—(CH_2)_k\text{-}L\text{-}(CH_2)_k—N(R^1)_2$$

wherein the indices k each have the same value and each $R^1$ is the same unit.

Preferably the backbone of the cyclic amines of the present invention comprise a N,N'-bis-substituted 1,4-piperazine ring having the formula:

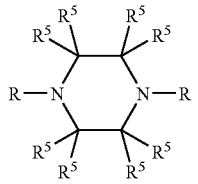

wherein each $R^5$ is independently hydrogen, $C_1$–$C_4$ alkyl, $C_1$–$C_4$ hydroxyalkyl, $C_1$–$C_4$ aminoalkyl, or two $R^5$ units of the same carbon atom are bonded to oxygen thus forming a carbonyl group (C═O) wherein the carbon atom is a ring atom, and mixture thereof. Examples of carbonyl containing rings which comprise L units are 1,4-diketopiperizines. A preferred backbone of the chlorine scavenging polyamines of the present invention, prior to modification, has the formula:

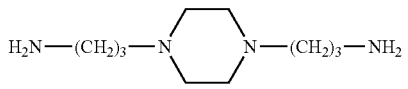

wherein each R unit is $—(CH_2)_3NH_2$ and each $R^5$ unit is hydrogen.

However, the cyclic units may be substituted on only one ring nitrogen as in the case wherein one R unit is hydrogen, and the other R unit is $—(CH_2)_kNH_2$, for example, the piperazine having the formula:

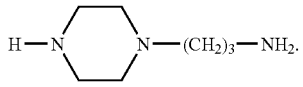

The backbones of the cyclic polyamines of the present invention preferably comprise at least one 1,3-propylene unit, more preferably at least two 1,3-propylene units.

Cationic Surfactants

The fabric enhancement compositions of the present invention may optionally comprise from about 0.5%, preferably from about 1% to about 10%, preferably to about 5% by weight, of one or more cationic nitrogen containing compound, preferably a cationic surfactant having the formula:

$$[R—\overset{+}{N}(R^1)_3]\ X^-$$

wherein R is $C_{10}$–$C_{18}$ alkyl, each $R^1$ is independently $C_1$–$C_4$ alkyl, X is a water soluble anion; preferably R is $C_{12}$–$C_{14}$, preferably $R^1$ is methyl. Preferred X is halogen, more preferably chlorine. Examples of cationic nitrogen compounds suitable for use in the fabric care compositions of the present invention are Non-limiting examples of preferred cationic nitrogen compounds are N,N-dimethyl-(2-hydroxyethyl)-N-dodecyl ammonium bromide, N,N-dimethyl-(2-hydroxyethyl)-N-tetradecyl ammonium bromide. Suitable cationic nitrogen compounds are available ex Akzo under the tradenames Ethomeen T/15®, Secomine TA15®, and Ethoduomeen T/20®.

METHOD OF USE

The present invention further relates to a method for providing protection and enhancement of fabric, said method comprising the step of contacting a fabric with a composition comprising:

a) from about 0.01%, preferably from about 0.1% to about 20%, preferably to about 10% by weight, of a fabric abrasion reducing polymer, said fabric abrasion polymer comprising:
   i) at least one monomeric unit comprising an amide moiety;
   ii) at least one monomeric unit comprising an N-oxide moiety;
   ii) and mixtures thereof;
b) optionally one or more fabric enhancement ingredients; and
c) the balance carriers;

provided the molecular weight of said fabric abrasion reducing polymer is greater than 100,000 daltons.

For the purposes of the present invention the term "contacting" is defined as "intimate contact of a fabric with an aqueous solution of the hereinabove described composition which comprises a fabric abrasion reducing polymer." Contacting typically occurs by soaking, washing, rinsing, spraying the composition onto fabric, but can also include contact of a substrate inter alia a material onto which the composition has been absorbed, with the fabric. Laundering is a preferred process. Temperatures for laundering can take place at a variety of temperatures, however, laundering typically occurs at a temperature less than about 30° C., preferably from about 5° C. to about 25° C.

TABLE I

| Ingredients | weight % | | | | | | |
|---|---|---|---|---|---|---|---|
| | 1 | 2 | 3 | 4 | 5 | 6 | 7 |
| Polymer[1] | 10.0 | 7.5 | 15.0 | 10.0 | 7.5 | 5.0 | 5.0 |
| Dye fixative[2] | — | 5.0 | 2.5 | 2.5 | 2.5 | — | 1.0 |
| Polyalkyleneimine[3] | — | — | 15.0 | — | — | — | 10.0 |
| Polyalkyleneimine[4] | — | — | — | 10.0 | — | — | — |
| Polyamine[5] | — | — | — | — | 25.0 | — | — |
| Fabric softener[6] | — | — | — | — | — | 15.0 | — |
| Bayhibit AM[7] | 1.0 | 1.0 | 0.2 | 1.0 | 1.0 | — | 1.0 |
| $NH_4Cl$ | — | — | — | 0.2 | 0.2 | — | 0.5 |
| $MgCl_2$ | — | — | — | — | — | — | 4.0 |
| SRP-2[8] | — | — | — | — | 0.5 | — | 1.0 |
| Optical brightener[9] | — | — | — | — | — | — | 0.2 |
| Water & minors | balance | balance | balance | balance | balance | balance | balance |

[1]Fabric abrasion reducing polymer polyvinylpyrrolidone K90 available ex BASF under the tradename Luviskol K90 ®.
[2]Dye fixing agent ex Clariant under the tradename Cartafix CB ®.
[3]PEI 1200 E4 according to U.S. Pat. No. 5,565,145 Watson et al., issued Oct. 15, 1996.
[4]PEI 1200 E1 according to U.S. Pat. No. 5,565,145 Watson et al., issued Oct. 15, 1996.
[5]N,N-bis(3-aminopropyl)-1,3-propylenediamine.
[6]Di-(tallowyl-oxy-ethyl) dimethyl ammonium chloride.
[7]2-Phosphonobutane-1,2,4-tricarboxylic acid ex Bayer.
[8]Diethoxylated poly(1,2-propyleneterephthalate) short block polymer.
[9]Disodium 4,4'-bis(2-sulphostyryl)biphenyl.

TABLE II

| Ingredients | weight % | | | | | | |
|---|---|---|---|---|---|---|---|
| | 8 | 9 | 10 | 11 | 12 | 13 | 14 |
| Polymer[1] | 10.0 | 7.5 | 15.0 | 10.0 | 7.5 | 5.0 | 5.0 |
| Dye fixative[2] | — | 5.0 | 2.5 | 2.5 | 2.5 | 2.5 | 2.5 |
| Polyalkyleneimine[3] | — | — | 15.0 | — | 10.0 | — | — |
| Polyalkyleneimine[4] | — | — | — | 5.0 | — | — | — |
| Polyamine[5] | — | — | — | — | 15.0 | 10.0 | 20.0 |
| Bayhibit AM[6] | 1.0 | 1.0 | 0.2 | 1.0 | 1.0 | 0.5 | 1.0 |
| $NH_4Cl$ | — | — | — | 0.2 | 0.2 | — | 0.2 |
| Water & minors | balance | balance | balance | balance | balance | balance | balance |

[1]Fabric abrasion reducing polymer polyvinylpyrrolidone K60 available ex BASF under the tradename Luviskol K60 ®.
[2]Dye fixing agent ex Clariant under the tradename Cartafix CB ®.
[3]PEI 1200 E4 according to U.S. Pat. No. 5,565,145 Watson et al., issued Oct. 15, 1996.
[4]PEI 1200 E1 according to U.S. Pat. No. 5,565,145 Watson et al., issued Oct. 15, 1996.
[5]N,N-bis(3-aminopropyl)-1,3-propylenediamine.
[6]2-Phosphonobutane-1,2,4-tricarboxylic acid ex Bayer.

TABLE III

| Ingredients | weight % | | | | | | |
|---|---|---|---|---|---|---|---|
| | 15 | 16 | 17 | 18 | 19 | 20 | 21 |
| Polymer[1] | 10.0 | 7.5 | 5.0 | 10.0 | 7.5 | 5.0 | 5.0 |
| Dye fixative[2] | — | 5.0 | 2.5 | 2.5 | 2.5 | — | 2.5 |
| Polyalkyleneimine[3] | — | — | 15.0 | — | — | — | — |
| Polyamine[4] | — | — | — | 15.0 | — | — | — |
| Polyamine[5] | — | — | — | — | 15.0 | 10.0 | 25.0 |
| Bayhibit AM[6] | 1.0 | 1.0 | 0.5 | 1.0 | 1.0 | — | 1.0 |
| $NH_4Cl$ | — | — | — | 0.2 | 0.2 | — | 0.2 |
| Water & minors | balance | balance | balance | balance | balance | balance | balance |

[1]Fabric abrasion reducing polymer polyvinylpyrrolidone-co-dimethylaminoethyl-methacrylate ex Aldrich.
[2]Dye fixing agent ex Clariant under the tradename Cartafix CB ®.
[3]PEI 1200 E4 according to U.S. Pat. No. 5,565,145 Watson et al., issued Oct. 15, 1996.
[4]N,N-bis(3-aminopropyl)-1,3-propylenediamine.
[5]1,4-Bis(3-aminopropyl)piperazine.
[6]2-Phosphonobutane-1,2,4-tricarboxylic acid ex Bayer.

TABLE IV

| Ingredients | weight % | | | | |
|---|---|---|---|---|---|
| | 22 | 23 | 24 | 25 | 26 |
| Polymer[1] | 5.0 | 1.0 | — | — | — |
| Polymer[2] | — | — | 0.5 | 2.0 | — |
| Polymer[3] | — | — | — | — | 2.5 |
| Softener active[4] | 2.6 | 18.0 | 19.0 | — | — |
| Tallow alcohol E25 | — | 1.0 | — | — | — |
| Fatty acid[5] | 0.3 | 1.0 | — | — | — |
| Hydrochloric acid | 0.02 | 0.02 | 0.02 | — | — |
| PEG 4000 | — | 0.6 | 0.6 | — | — |
| Perfume | 1.0 | 1.0 | 1.0 | 0.1 | 0.1 |
| Silicone antifoam | 0.01 | 0.01 | 0.01 | — | — |
| Polyalkyleneamine[6] | 3.0 | 3.0 | — | 15.0 | — |
| Polyamine[7] | — | — | 5.0 | — | 10.0 |
| Dye fixative[8] | 1.0 | — | 5.0 | — | 10.0 |
| Dye fixative[9] | — | 3.0 | — | 5.0 | — |
| HEDP[10] | 0.2 | — | — | 0.4 | — |
| $CaCl_2$ (ppm) | — | 600 | 1200 | — | — |
| Dye (ppm) | 10 | 50 | 50 | — | — |
| Water & Minors | balance | balance | balance | balance | balance |

[1]Fabric abrasion reducing polymer polyvinylpyrrolidone K90 available ex BASF under the tradename Luviskol K90 ®.
[2]Fabric abrasion reducing polymer polyvinylpyrrolidone K60 available ex BASF under the tradename Luviskol K60 ®.
[3]Fabric abrasion reducing polymer polyvinylpyrrolidone-co-dimethylaminoethyl-methacrylate ex Aldrich.
[4]Di-(tallowyl-oxy-ethyl) dimethyl ammonium chloride.
[5]Tallow fatty acid having an Iodine Value of 18.
[6]PEI 1200 E4 according to U.S. Pat. No. 5,565,145 Watson et al., issued Oct. 15, 1996.
[7]N,N-bis(3-aminopropyl)-1,3-propylenediamine.
[8]Cellulose reactive dye fixing agent ex Clariant under the tradename Indosol CR ®.
[9]Cellulose reactive dye fixing agent ex CHT R. Beitlich under the tradename Rewin WBS ®.
[10]1,1-hydroxyethane diphosphonic acid.

TABLE V

| Ingredients | weight % | | | |
|---|---|---|---|---|
| | 27 | 28 | 29 | 30 |
| Polymer[1] | 5.0 | 1.0 | 2.0 | 1.0 |
| Softener active[2] | — | — | — | 15.0 |
| Softener active[3] | 2.6 | 19.0 | — | — |
| Tallow alcohol E25 | 0.3 | — | — | — |
| Fatty acid[4] | 0.3 | — | — | — |
| Hydrochloric acid | 0.02 | 0.02 | — | 0.02 |
| PEG 4000 | — | 0.6 | — | 0.6 |
| Perfume | 1.0 | 1.0 | 0.1 | 1.0 |
| Silicone antifoam | 0.01 | 0.01 | — | 0.01 |
| Polyalkyleneamine[5] | 3.0 | 3.0 | 10.0 | 3.0 |
| Dye fixative[6] | 1.0 | 3.0 | 10.0 | 1.0 |
| Dye fixative[7] | 2.0 | — | — | 2.0 |
| $CaCl_2$ (ppm) | — | 600 | — | 600 |
| Dye (ppm) | 10 | 50 | — | 50 |
| Water & Minors | balance | balance | balance | balance |

[1]Fabric abrasion reducing polymer polyvinylpyrrolidone K90 available ex BASF under the tradename Luviskol K90 ®.
[2]Ditallow dimethylammonium chloride.
[3]Di-(tallowyl-oxy-ethyl) dimethyl ammonium chloride.
[4]Tallow fatty acid having an Iodine Value of 18.
[5]PEI 1200 E4 according to U.S. Pat. No. 5,565,145 Watson et al., issued Oct. 15, 1996.
[6]Cellulose reactive dye fixing agent ex Clariant under the tradename Indosol CR ®.
[7]Cellulose reactive dye fixing agent ex CHT R. Beitlich under the tradename Rewin WBS ®.

The following are non-limiting examples of the compositions of the present invention which are suitable for delivery via a substrate dryer sheet.

TABLE VI

| Ingredients | weight % | | | | | |
|---|---|---|---|---|---|---|
| | 31 | 32 | 33 | 34 | 35 | 36 |
| Polymer[1] | 20.0 | 30.0 | 10.0 | 5.0 | 7.5 | 15.0 |
| Softener active[2] | 40.0 | 25.0 | — | — | — | — |
| Softener active[3] | — | — | 20.0 | — | — | — |
| Softener active[4] | — | — | — | 20.0 | 12.0 | 60.0 |
| Softener active[5] | 30.0 | 30.0 | 20.0 | 30.0 | 20.0 | — |
| Glycosperse S-20[6] | — | — | 10.0 | — | — | — |
| Glycerol monostearate | — | — | — | 20.0 | 10.0 | — |
| Clay | 4.0 | 4.0 | 3.0 | 4.0 | 4.0 | — |
| Perfume | 0.7 | 1.1 | 0.7 | 1.6 | 2.6 | 1.4 |
| Polyalkyleneimine[7] | — | 5.0 | — | — | — | — |
| Polyalkyleneimine[8] | — | — | 4.0 | 2.2 | — | — |
| Polyalkyleneimine[9] | 2.0 | — | — | — | 5.0 | 7.0 |
| Dye fixative[10] | 2.0 | 5.0 | 4.0 | 2.2 | 5.0 | 3.0 |
| HEDP[11] | 0.2 | — | 0.5 | — | — | 0.7 |
| Glycolic acid | — | 0.2 | — | 0.2 | — | — |
| Polycarboxylic[12] | — | 0.2 | — | — | 0.4 | — |
| Stearic acid | balance | balance | balance | balance | balance | balance |

[1]Fabric abrasion reducing polymer polyvinylpyrrolidone K60 available ex BASF under the tradename Luviskol K60 ®.
[2]Di-(oleyloxyethyl) dimethyl ammonium methylsulfate.
[3]Di-(soft-tallowyl-oxy-ethyl) hydroxyethyl methyl ammonium methylsulfate.
[4]Ditallow dimethyl ammonium methylsulfate.
[5]1:2 ratio of stearyl dimethyl amine:triple-pressed stearic acid.
[6]Polyethoxylated sorbitan monostearate ex Lonza.
[7]PEI 1800 E1 according to U.S. Pat. No. 5,565,145 Watson et al., issued Oct. 15, 1996.
[8]PEI 1200 E4 according to U.S. Pat. No. 5,565,145 Watson et al., issued Oct. 15, 1996.
[9]PEI 1800 E4 according to U.S. Pat. No. 5,565,145 Watson et al., issued Oct. 15, 1996.
[10]Cellulose reactive dye fixing agent ex Clariant under the tradename Indosol CR ®.
[11]1,1-Hydroxyethane diphosphonic acid.
[12]Polycarboxylic compound ex BASF under the tradename Sokalan CP 10 ®.

The following are non-limiting examples of pre-soak fabric conditioning and/or fabric enhancement compositions according to the present invention which can also be suitably used in the laundry rinse cycle. The following provide fabric abrasion protection for fabric treated with said compositions.

TABLE VII

| Ingredients | weight % | | |
|---|---|---|---|
| | 37 | 38 | 39 |
| Polymer[1] | 3.5 | 3.5 | 3.5 |
| Dye fixative[2] | 2.3 | 2.4 | 2.5 |
| Polyamine[3] | 15.0 | 17.5 | 20.0 |
| Bayhibit AM[4] | 1.0 | 1.0 | 1.0 |
| Water & minors | balance | balance | balance |

[1]Fabric abrasion reducing polymer polyvinylpyrrolidone K90 available ex BASF under the tradename Luviskol K90 ®.
[2]Dye fixative ex Clariant under the tradename Cartafix CB ®.
[3]1,4-Bis-(3-aminopropyl)piperazine.
[4]2-Phosphonobutane-1,2,4-tricarboxylic acid ex Bayer.

TABLE VIII

| Ingredients | weight % | | |
|---|---|---|---|
| | 40 | 41 | 42 |
| Polymer[1] | 3.5 | 3.5 | 3.5 |
| Dye fixative[2] | 2.3 | 2.4 | 2.5 |

TABLE VIII-continued

| Ingredients | weight % 40 | 41 | 42 |
|---|---|---|---|
| Polyamine[3] | 15.0 | 17.5 | 20.0 |
| Bayhibit AM[4] | 1.0 | 1.0 | 1.0 |
| $C_{12}$–$C_{14}$ Dimethyl Hydroxyethyl Quaternary Ammonium Chloride | 5.0 | 5.0 | 5.0 |
| Fabric softener active[5] | 2.5 | 2.5 | 2.5 |
| Genamine C100 | 0.33 | 0.33 | 0.33 |
| Water & minors | balance | balance | balance |

[1]Fabric abrasion reducing polymer polyvinylpyrrolidone K90 available ex BASF under the tradename Luviskol K90 ®.
[2]Dye fixative ex Clariant under the tradename Cartafix CB ®.
[3]1,4-Bis-(3-aminopropyl)piperazine.
[4]2-Phosphonobutane-1,2,4-tricarboxylic acid ex Bayer.
[5]Di-(canoloyl-oxy-ethyl) hydroxyethyl methyl ammonium methylsulfate.

TABLE IX

| Ingredients | Weight % 43 | 44 | 45 | 46 |
|---|---|---|---|---|
| Polymer[1] | — | 7.5 | 3.5 | 3.5 |
| Dye fixative[2] | 2.5 | 5.0 | 2.4 | 2.4 |
| Polyamine[3] | — | 5.0 | 10.0 | — |
| Polyamine[4] | — | — | — | 10.0 |
| Bayhibit[5] | 1.0 | 1.0 | 1.0 | 1.0 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]1,1-N-dimethyl-9,9-N"-dimethyl dipropylenetriamine.
[4]1,1-N-dimethyl-5-N'-methyl-9,9-N"-dimethyl dipropylenetriamine.
[5]2-Phosphonobutane-1,2,4-tricarboxylic acid ex Bayer.

TABLE X

| Ingredients | Weight % 47 | 48 | 49 | 50 |
|---|---|---|---|---|
| Polymer[1] | 3.5 | 3.5 | 2.0 | — |
| Dye fixative[2] | 2.4 | 2.4 | 1.0 | 2.5 |
| Polyamine[3] | 15.0 | 17.0 | 5.0 | 7.0 |
| Fabric softener[4] | — | — | 10.0 | — |
| Bayhibit[5] | 1.0 | 1.0 | 0.2 | 1.0 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]N,N'-bis(3-aminopropyl)-1,4-piperazine.
[4]Di (tallowyloxyethyl)dimethyl ammonium chloride.
[5]2-Phosphonobutane-1,2,4-tricarboxylic acid ex Bayer.

TABLE XI

| Ingredients | Weight % 51 | 52 | 53 | 54 |
|---|---|---|---|---|
| Polymer[1] | 4.5 | 4.5 | 3.5 | 3.5 |
| Dye fixative[2] | 2.4 | 2.4 | 2.4 | 2.4 |
| Polyamine[3] | 7.0 | 8.0 | — | — |
| Polyamine[4] | — | — | 15.0 | — |
| Polyamine[5] | — | — | — | 15.0 |
| Bayhibit[6] | 1.0 | 1.0 | 1.0 | 1.0 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]1,1-N-dimethyl-9,9-N"-dimethyl dipropylenetriamine.
[4]1,1-N-dimethyl-5-N'-methyl-9,9-N"-dimethyl dipropylenetriamine.
[5]N,N'-bis(3-aminopropyl)-1,4-piperazine.
[6]2-Phosphonobutane-1,2,4-tricarboxylic acid ex Bayer.

TABLE XII

| Ingredients | Weight % 55 | 56 | 57 | 58 |
|---|---|---|---|---|
| Polymer[1] | 4.5 | 4.5 | 3.5 | 3.5 |
| Dye fixative[2] | 2.4 | 2.4 | 2.4 | 2.0 |
| Polyamine[3] | — | — | 17.0 | 25.0 |
| Polyamine[4] | 20.0 | 25.0 | — | — |
| Bayhibit[5] | 1.0 | 1.0 | 1.0 | 0.2 |
| Water | balance | balance | balance | balance |

[1]Polyvinylpyrrolidone K85 available ex BASF as Luviskol ® K85.
[2]Dye fixing agent ex Clariant under the tradename Cartafix CB ®.
[3]N,N'-bis(3-aminopropyl)-1,4-piperazine.
[4]1,1-N-dimethyl-5-N'-methyl-9,9-N"-dimethyl dipropylenetriamine.
[5]2-Phosphonobutane-1,2,4-tricarboxylic acid ex Bayer.

What is claimed is:

1. A fabric care composition comprising:

from about 0.01% to about 20% by weight, of a fabric abrasion reducing homopolymer wherein said fabric abrasion reducing homopolymer consists of a unit having comprises a the formula:

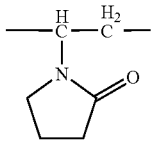

wherein said composition further comprises a bleach protection polyamine selected from the group consisting of 1,4-bis-(3-aminopropyl)piperazine, 1,1-N-dimethyl-5-N'-methyl-9,9-N"-dimethyl dipropylenetriamine, 1,1-N-dimethyl-9,9-N"-dimethyl dipropylenetriamine, N,N'-bis(3-aminopropyl)-1,3-propylenediamine, and mixtures thereof.

2. The composition of claim 1 further comprising from 0.01% to 80% by weight of a fabric softening active.

3. A composition according to claim 1 further comprising a dispersibility aid system, said system comprising:

i) 0.2% of ethoxylated cocoyl amine having an average of 10 ethoxy units; and ii) 0.1% of ethoxylated cocoyl alcohol having an average of 10 ethoxy units.

4. A method for providing fabric with decreased abrasion damage comprising the step of contacting a fabric with a composition according to claim 1.

5. A composition according to claim 1, comprising from 0.001% to 50% by weight, of a dye fixing agent and comprising from 0.01% to 50% by weight of said bleach protection polyamine.

* * * * *